US011831085B2

(12) United States Patent
Wu et al.

(10) Patent No.: US 11,831,085 B2
(45) Date of Patent: Nov. 28, 2023

(54) COMPACT ANTENNA RADIATING ELEMENT

(71) Applicant: CommScope Technologies LLC, Hickory, NC (US)

(72) Inventors: Bo Wu, Suzhou (CN); Runmiao Wu, Suzhou (CN); Ligang Wu, Suzhou (CN); Fusheng Lv, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 365 days.

(21) Appl. No.: 17/269,914

(22) PCT Filed: Sep. 11, 2019

(86) PCT No.: PCT/US2019/050557
§ 371 (c)(1),
(2) Date: Feb. 19, 2021

(87) PCT Pub. No.: WO2020/060816
PCT Pub. Date: Mar. 26, 2020

(65) Prior Publication Data

US 2022/0352649 A1 Nov. 3, 2022

(30) Foreign Application Priority Data

Sep. 18, 2018 (CN) ..... 201811084738.5

(51) Int. Cl.

| | |
|---|---|
| ***H01Q 21/26*** | (2006.01) |
| ***H01Q 9/26*** | (2006.01) |
| ***H01Q 19/10*** | (2006.01) |
| ***H01Q 1/52*** | (2006.01) |

(52) U.S. Cl.
CPC ..... *H01Q 21/26* (2013.01); *H01Q 1/52* (2013.01); *H01Q 1/521* (2013.01); *H01Q 9/26* (2013.01); *H01Q 19/10* (2013.01); *H01Q 19/104* (2013.01)

(58) Field of Classification Search
CPC ..... H01Q 21/26; H01Q 9/26; H01Q 19/104; H01Q 1/521; H01Q 19/10; H01Q 1/52
USPC ..... 343/702
See application file for complete search history.

(56) References Cited

U.S. PATENT DOCUMENTS

| | | | | |
|---|---|---|---|---|
| 5,481,272 | A | 1/1996 | Yarsunas | |
| 6,373,446 | B2 * | 4/2002 | Apostolos | H01Q 21/24 343/742 |
| 2004/0080462 | A1 * | 4/2004 | Apostolos | H01Q 9/145 343/741 |

(Continued)

FOREIGN PATENT DOCUMENTS

| | | | |
|---|---|---|---|
| CN | 102142603 | A | 8/2011 |
| CN | 103339798 | A | 10/2013 |

OTHER PUBLICATIONS

"International Search Report and Written Opinion of the International Searching Authority", International Application No. PCT/US2019/050557, dated Jan. 7, 2020, 10 pp.

(Continued)

*Primary Examiner* — Hai V Tran
(74) *Attorney, Agent, or Firm* — Myers Bigel, P.A.

(57) ABSTRACT

A radiating element for an antenna comprises at least one radiating arm having a first electrically conductive arm segment extending in a first direction and a second electrically conductive arm segment extending in a second direction and electrically connected to the first arm segment.

18 Claims, 6 Drawing Sheets

(56) References Cited

U.S. PATENT DOCUMENTS

| | | | | |
|---|---|---|---|---|
| 2006/0038734 | A1 | 2/2006 | Shtrom et al. | |
| 2007/0115199 | A1* | 5/2007 | Apostolos | H01Q 7/00 343/705 |
| 2011/0037672 | A1 | 2/2011 | Tseng et al. | |
| 2012/0081259 | A1 | 4/2012 | Regala | |

OTHER PUBLICATIONS

"Chinese Office Action in Corresponding Application No. 201811084738.5, dated Aug. 2, 2023, 10 pages (22 pages total)".

* cited by examiner

COMPACT ANTENNA RADIATING ELEMENT

CROSS-REFERENCE TO RELATED APPLICATIONS

The present application is a 35 U.S.C. § 371 national stage application of PCT Application No. PCT/US2019/050557, filed Sep. 11, 2019, which itself claims priority to Chinese Patent Application Serial No. 201811084738.5, filed Sep. 18, 2018, the entire contents of both of which are incorporated herein by reference. The above-referenced PCT Application was published in the English language as International Publication No. WO 2020/060816 A1 on Mar. 26, 2020.

FIELD

The present invention relates to antenna radiating elements. More specifically, the present invention relates to compact antenna radiating elements. In addition, the present invention also relates to feed stalks for antennas and antennas with the compact antenna radiating elements.

BACKGROUND

At present, Multiple-Input Multiple-Output (MIMO) technology is regarded as a core technology of next-generation mobile communications. MIMO technology refers to the use of a plurality of arrays of transmitting radiating elements and/or arrays of receiving radiating elements at a transmitting end and/or a receiving end, respectively, so that signals are transmitted and/or received through a plurality of arrays of radiating elements, thereby improving communication quality. Such antennas are commonly referred to as MIMO antennas. However, as the number of arrays of radiating elements mounted on a reflecting plate increases, the spacing between radiating elements of different arrays is typically decreased, which results in increased coupling interference between the arrays, resulting in deterioration of the isolation performance of the radiating elements, thereby eventually affecting the beam forming (BF) of the antennas.

SUMMARY

According to a first aspect of the present invention, there is provided a radiating element for an antenna. The radiating element includes at least one radiating arm. The radiating arm has a first electrically conductive arm segment extending in a first direction and a second electrically conductive arm segment extending in a second direction from a radially outer end region of the first electrically conductive arm segment, the second direction being different from the first direction. The first arm segment and the second arm segment are constructed separately. The second arm segment is electrically connected to the first arm segment.

The radiating element according to the present invention may be a printed circuit board (PCB)-based radiating element or a die-cast radiating element. The first arm segment and/or the second arm segment may be made of a metal such as copper or aluminum.

The radiating arm of the radiating element according to the present invention comprises a first arm segment and a second arm segment. The length of the first arm segment and the second arm segment may be flexibly defined according to actual application situations. By additionally providing the second arm segment, the horizontal extension dimension of the radiating arm may be reduced, thereby improving the space utilization rate of the radiating element, reducing the spatial size of the radiating element as a whole, and enlarging the distance between the adjacent radiating elements. As a result, the coupling interference between the radiating elements is weakened and the isolation therebetween is improved.

In some embodiments, the total length of the combination of the first arm segment and the second arm segment is equivalent to the radiating arm length of a half-wave radiating element.

In some embodiments, the radiating arm length of the half-wave radiating element is from 50% to 150%, preferably from 80% to 120%, more preferably from 90% to 110% of the theoretical radiating arm length of the half-wave radiating element, wherein the theoretical radiating arm length of the half-wave radiating element equals one quarter of a wavelength corresponding to the intermediate frequency of the operating band of the half-wave radiating element.

In some embodiments, the total length of the combination of the first arm segment and the second arm segment is equivalent to the radiating arm length of a full-wave radiating element.

In some embodiments, the radiating arm length of the full-wave radiating element is between 50% to 150%, preferably from 80% to 120%, more preferably from 90% to 110% of the theoretical radiating arm length of the full-wave radiating element, wherein the theoretical radiating arm length of the full-wave radiating element equals one half of a wavelength corresponding to a center frequency of the operating band of the full-wave radiating element.

In some embodiments, a feed circuit of the radiating element connects to the first arm segment. the length of the first arm segment is between 20% and 90%, preferably between 60% and 80%, more preferably between 70% and 80% of the radiating arm length of the half-wave radiating element.

In some embodiments, a feed circuit of the radiating element connects to the first arm segment. the length of the first arm segment is between 20% and 90%, preferably between 60% and 80%, more preferably between 70% and 80% of the radiating arm length of the full-wave radiating element.

In some embodiments, the first arm segment extends above and parallel to a reflector plate, and the second arm segment extends downwardly from the first arm segment toward the reflector plate.

In some embodiments, the second arm segment may be electrically connected to the first arm segment by means of soldering.

In some embodiments, the second arm segment may be electrically connected to the first arm segment by means of capacitive connection. The use of the capacitive connection can effectively reduce the passive intermodulation (PIM) of the antennas.

In some embodiments, the second direction intersects the first direction, which means that the second arm segment is not in parallel with the first arm segment.

In some embodiments, the second direction and the first direction form an angle of between 80 and 100 degrees. It is also possible that the second direction and the first direction form an angle of between 60 and 130 degrees. That is, the second arm segment and the first arm segment intersect each other.

In some embodiments, the first arm segment is configured as a metal member.

In some embodiments, the metal member is a metal sheet or a metal column.

According to the present invention, the first arm segment may be configured as a metal sheet, for example, a copper metal sheet or an aluminum metal sheet. It is also possible that the first arm segment may be configured as a metal column, for example, a copper metal column or an aluminum metal column. The metal member (metal sheet or metal column) may be fabricated by die casting.

In some embodiments, the first arm segment is constructed on a first PCB.

In some embodiments, the second arm segment is constructed on a second PCB.

In some embodiments, the second PCB is configured as a feed stalk of the radiating element.

In some embodiments, the second arm segment is configured as an electrically conductive segment on the feed stalk, and the electrically conductive segment is electrically separated from a feed circuit of the feed stalk.

According to the present invention, the second arm segment may be constructed on the feed stalk, wherein a substrate of the feed stalk extends towards both sides to form a space for accommodating the second arm segment. This embodiment is particularly advantageous in that it can significantly increase the manufacturing and assembling efficiency of the radiating elements, eliminates the cumbersome process of soldering metal members on each radiating arm to thereby save labor costs, allows the second arm segment to be considered upon design of the PCB to make the design of the second arm segment more flexible, and reduces a large number of discrete elements for the second arm segment being integrated on the feed stalk.

In some embodiments, the electrically conductive segment is constructed on at least one surface of the feed stalk.

In some embodiments, the electrically conductive segment is constructed on two surfaces of the feed stalk. the electrically conductive segment is provided with at least one conductive element that extends through a dielectric substrate of the feed stalk to electrically connect the two surfaces.

In some embodiments, the second arm segment is configured as a metal member.

In some embodiments, the metal member is a metal sheet or a metal column.

According to the present invention, the second arm segment may be configured as a metal sheet, for example, a copper metal sheet or an aluminum metal sheet. It is also possible that the second arm segment may be configured as a metal column, for example, a copper metal column or an aluminum metal column. The metal member (metal sheet or metal column) may be fabricated by die casting.

In principle, the first arm segment and the second arm segment according to the present invention may be configured in a variety of ways: metal member+PCB, metal member+metal member, PCB+PCB, PCB+metal member.

According to a second aspect of the present invention, there is provided a radiating element. The radiating element comprises a feed stalk that includes a feed circuit and a radiating arm. the radiating arm includes a first electrically conductive segment that is mounted on the feed stalk and a second electrically conductive segment that is implemented on the feed stalk and is electrically connected to the feed circuit through the first electrically conductive segment.

According to a third aspect of the present invention, there is provided an antenna, wherein the antenna comprises at least one radiating element according to the present invention.

In some embodiments, the antenna is configured as an MIMO antenna.

DETAILED DESCRIPTION

The radiating elements according to embodiments of the present invention are applicable to various types of antennas, and may be particularly suitable for MIMO antennas. MIMO antennas typically have multiple arrays of radiating elements. The arrays may be, for example, linear arrays of radiating elements or two-dimensional arrays of radiating elements. Only a single radiating element is shown below. It should be noted that in the discussion that follows, the radiating elements are described consistent with the orientation shown in the figures. It will be appreciated that base station antennas are typically mounted so that a longitudinal axis thereof extends in the vertical direction, and the reflector plate of the antenna likewise extends vertically. When mounted in this fashion, the radiating elements typically extend forwardly from the reflector plate, and hence are oriented about 90° from the orientations shown in FIGS. 1, 3 and 5 below.

Figure 1:
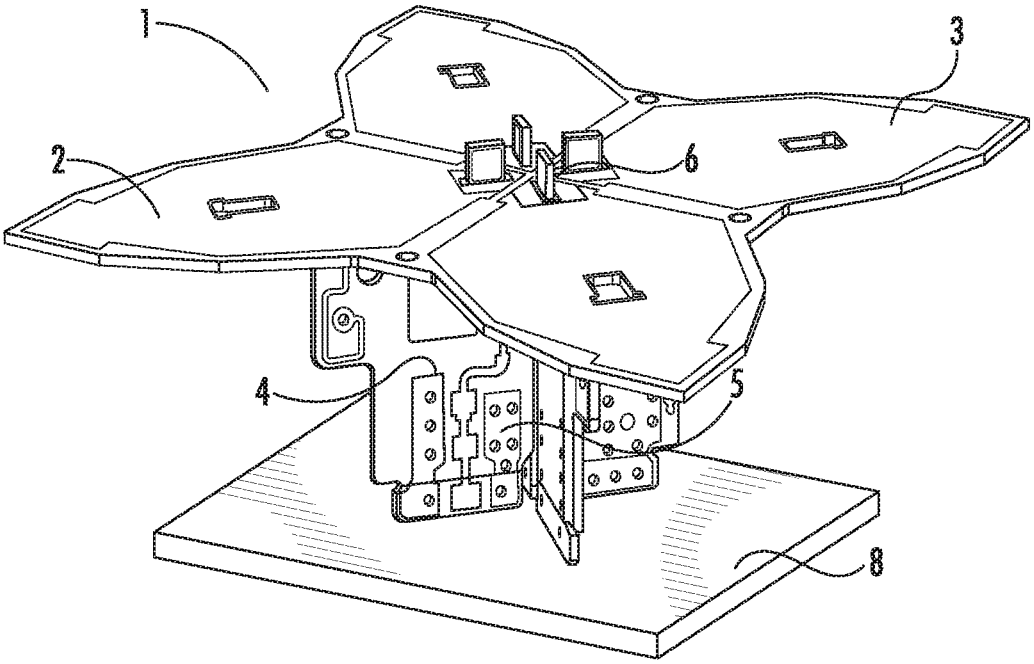
FIG. 1 is a perspective view of a conventional radiating element.
Figure 2:
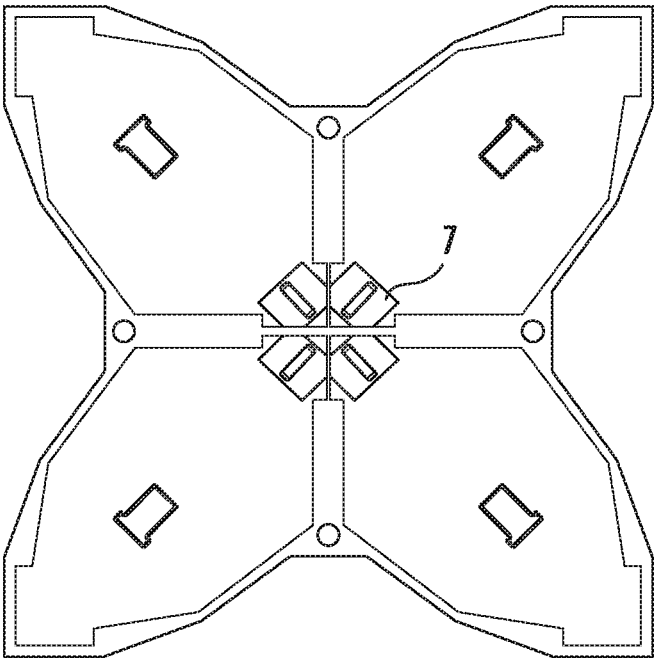
FIG. 2 is a top view of the conventional radiating element.

Referring now to FIGS. 1 and 2, a perspective view and a top view of a conventional radiating element are shown. As shown in FIGS. 1 and 2, a radiating element 1 is a dual-polarization "cross-dipole" mid band radiating element that may operate in the 1710 MHz to 2690 MHz frequency band, or one or more portions thereof. The dual-polarization mid band radiating element 1 has two horizontally-extending dipoles, both of which may be disposed on a dipole printed circuit board. Each dipole has two radiating arms 2, 3 arranged at 180 degrees from each other. For a half-wave radiating element, the length of each of the radiating arms 2, 3 corresponds to one quarter of the theoretical wavelength. For a full-wave radiating element, the length of each of the radiating arms 2, 3 corresponds to one-half of the theoretical wavelength. The theoretical wavelength generally refers to a wavelength corresponding to a center frequency of the operating band of the radiating element. Of course, it is also possible to deviate from the theoretical length.

The radiating element 1 further comprises a feed stalk 4 that extends vertically from a reflecting plate 8. The feed stalk 4 may be constructed as a pair of printed circuit hoards that are oriented at an angle of 90° with respect to each other so as to have a cross-section in the form of an X. A feed board printed circuit board (not shown) may be mounted on the reflecting plate 8, and a base of the feed stalk 4 may be mounted on the feed board printed circuit board. A feed circuit 5 is provided on each printed circuit board of the feed stalk 4. Each of the radiating arms 2, 3 may be mounted on a feed end 6 of the feed stalk 4. Tabs that are provided on the upper end of each printed circuit board of the feed stalk 4 are inserted into slots 7 in the dipole printed circuit board in order to mount the dipole printed circuit board on the feed stalk 4. The feed circuits 5 may provide respective signal paths from the feed board printed circuit board to each respective pair of radiating arms 2, 3. In order to further enhance this electrical connection, the feed stalk printed circuit boards may be fixedly connected to the dipole printed circuit board, for example, by means of soldering.

As described above, as a large number of radiating elements (for example, one or more arrays of low band radiating elements, one or more arrays of mid band radiating elements, and one or more arrays of high band radiating elements) are integrated on the reflecting plate with limited area, the spacing between the radiating elements is reduced. This results in the isolation between different radiating elements, especially between dipoles of the same polarization (also referred to as Co-pol isolation) getting worse. At present, a principal challenge in the design of MIMO antennas is to improve the isolation between the radiating elements, especially the isolation between radiating elements of different arrays that operate at the same frequency (e.g. two mid band linear arrays), as this can affect the beam forming performance of the antennas.

Figure 3:
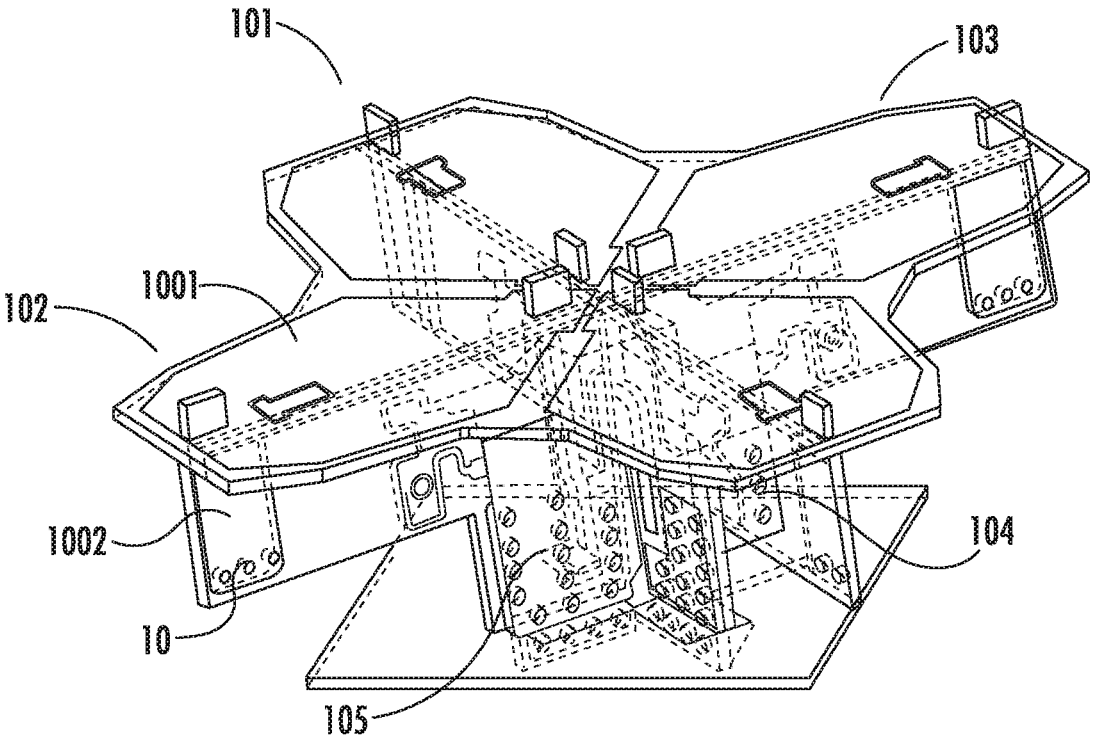
FIG. 3 is a perspective view of a radiating element in accordance with a first embodiment of the present invention.
Figure 4:
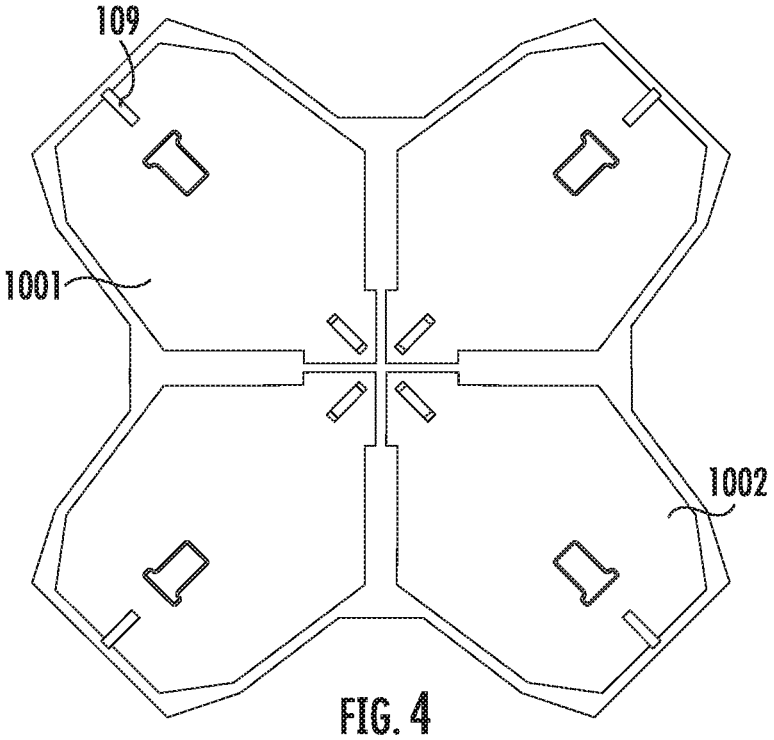
FIG. 4 is a top view of the radiating element in accordance with the first embodiment of the present invention.

Referring to FIGS. 3 and 4, a perspective view and a top view of a radiating element according to a first embodiment of the present invention are shown. As shown in FIGS. 3 and 4, a radiating element 101 is a dual-polarization cross-dipole mid band radiating element. Each dipole has two radiating arms 102, 103. As can be seen from FIG. 3, each of the radiating arms 102, 103 has a first arm segment 1001 and a second arm segment 1002 that extends perpendicular to the first arm segment 1001. The first arm segment 1001 is disposed on a PCB, while the second arm segment 1002 is disposed on another PCB.

In the present example, the PCB where the second arm segment 1002 is located is a feed stalk 104 of the radiating element 101. The second arm segment 1002 is configured as a pair of rectangular electrically conductive segments on two opposite surfaces of the feed stalk 104. It can also be seen from the figures that a plurality of conductive elements 10 penetrate through the dielectric substrate of the feed stalk PCB to electrically connect the two rectangular electrically conductive segments. Between the rectangular electrically conductive segment and a feed circuit 105 of the feed stalk 104 is a substrate of the PCB, such as a paper substrate, a glass fiber substrate or a composite substrate, thereby maintaining an electrical separation between the second arm segment 1002 and the feed circuit 105.

As can be seen from FIG. 3, the feed stalk 104 extends radially outward such that the radial dimension of the feed stalk 104 is substantially consistent with that of the first arm segment 1001. As can be seen from FIG. 4, the first arm segment 1001 is provided with a groove 109 in its radially outer end (i.e. an end remote from a feed end). The second arm segment 1002 is provided with a protruding electrically conductive segment at a radially outward end. Each second arm segment 1002 includes a protruding electrically conductive segment that is inserted into the groove 109 of a respective one of the first arm segments 1001. The second arm segment 1002 may be mechanically connected to the first arm segment 1001 in a radially outer end region of the first arm segment 1001, thereby realizing an electrical connection of the second arm segment 1002 with the first arm segment 1001. Herein, the radially outer end region of the first arm segment refers to the portion of the first arm segment that comprises the outer 25% of the first arm segment along the length of the first arm segment. In order to further enhance this electrical connection, each second arm segment 1002 may be soldered or otherwise permanently connected to a respective one of the first arm segments 1001. Of course, the first arm segment 1001 and the second arm segment 1002 may also be electrically connected by means of a capacitive connection. The use of the capacitive connection may effectively reduce the passive intermodulation (PIM) of the antennas. In this way, the first arm segment 1001 and the second arm segment 1002 are formed as an integral radiating arm.

For a half-wave radiating element, the total length of the first arm segment 1001 and the second arm segment 1002 may be equivalent to the theoretical radiating arm length of the half-wave radiating element. In principle, the theoretical radiating arm length of the half-wave radiating element equals one quarter of a wavelength corresponding to the center frequency of the operating band of the half-wave radiating element. For example, for a mid-band radiating element that operates in the 1690 MHz to 2690 MHz frequency band, its theoretical radiating arm length may be one quarter of a wavelength corresponding to 2190 MHz, that is, 35 mm. Of course, the actual radiating arm length may deviate from the theoretical radiating arm length according to actual application scenarios. The actual radiating arm length may be, for example, from 80% to 120% of the theoretical radiating arm length, that is, 28 mm to 42 mm in some embodiments. In other embodiments, the actual radiating arm length may be, for example, from 50% to 150% of the theoretical radiating arm length, that is, 18 mm to 53 mm.

For a full-wave radiating element, the total length of the first arm segment 1001 and the second arm segment 1002 may be equivalent to the theoretical radiating arm length of the full-wave radiating element. In principle, the theoretical radiating arm length of the full-wave radiating element equals one half of a wavelength corresponding to the center frequency of the operating band of the full-wave radiating element. For example, for a mid-band radiating element that operates in the 1690 MHz to 2690 MHz frequency band, its theoretical radiating arm length may be one half of a wavelength corresponding to 2190 MHz, that is, 70 mm. Of course, the actual radiating arm length may also deviate from the theoretical radiating arm length according to actual application scenarios. The actual radiating arm length may be, for example, from 80% to 120% of the theoretical radiating arm length, that is, 56 mm to 84 mm in some embodiments. In other embodiments, the actual radiating arm length may be, for example, from 50% to 150% of the theoretical radiating arm length, that is, 35 mm to 105 mm.

In the conventional dipole radiating element, the actual radiating arm length L1 of the radiating arms 2, 3 is the dimension of horizontal extension. The actual radiating arm length L1 is graphically shown in FIG. 2. In the radiating element 101 according to embodiments of the present invention, the actual radiating arm length L2 of each radiating arm 102, 103 is the sum of the length L3 of the first arm segment 1001 that extends horizontally and the length L4 of the second arm segment 1002 that extends vertically. The lengths L3 and L4 are graphically shown in FIGS. 3 and 4 (It should be noted that the length L4 does not take the protruding electrically conductive segment of the second arm segment 1002 into consideration). Thus, the dimension of horizontal extension of the radiating elements is reduced (i.e., L3<L1), thereby enlarging the spacing between the adjacent radiating elements and improving the isolation between adjacent radiating elements. Of course, the length L1 of the first arm segment 1001 cannot be reduced without limit, and it is also necessary to take into consideration the space in which the second arm segment 1002 can be accommodated, as well as other performance parameters of the radiating elements, such as return loss, PIM, and the like.

In the present example, it is advantageous that the first arm segment 1001 and the second arm segment 1002 are respectively constructed on separate PCBs, because rigid PCBs generally cannot be bent, and flexible PCBs may be expensive and may need to be held in a fixed position once mounted for use, which may require additional structural support elements. However, it will be appreciated that in other embodiments a single flexible printed circuit board could be used to form the radiating arms 102, 103 that have horizontal first arm segments 1001 and non-horizontal second arm segments 1002. Not that in such flexible printed circuit board implementations the second arm segments 1002 need not extend vertically, but could extend at other angles from the horizontal.

In the example of FIGS. 3-4, the second arm segment 1002 is formed on the feed stalk. This construction may be particularly advantageous because it can improve the manufacturing and assembling efficiency for the radiating elements, may eliminate the cumbersome process of soldering metal members on each radiating arm to thereby save labor costs, allows the second arm segment 1002 to be considered upon design of the PCB to make the design of the second arm segment 1002 more flexible, and reduces a large number of discrete elements for the second arm segment 1002 being integrated on the feed stalk.

In other examples, radiating elements according to embodiments of the present invention may be provided that are low band radiating elements that may operate in the 617 MHz to 960 MHz frequency band, or one or more portions thereof, or may be high band radiating elements that operate in portions of the 3 GHz or 5 GHz frequency bands. The radiating elements according to embodiments of the present invention also have applicability to other frequency bands.

In other examples, the radiating element may be of any other design. The dipole and/or feed stalk of the radiating element may also be manufactured directly by means of die casting. For example, the first arm segment may not be disposed on a PCB, but may instead be constructed as a metal sheet (for example, a copper metal sheet). Likewise, the second arm segment may also be constructed as a metal column (for example, a copper metal column).

In other examples, the radiating element may be a single-polarization radiating element. Further, the second arm segment need not be perpendicular to the first arm segment. For example, the second arm segment may be connected to the first arm segment at a certain angle of inclination (e.g., 10 degrees, 45 degrees, 75 degrees, etc.). Furthermore, the second arm segment may also be of any other design. For example, the second arm segment may be configured as a trapezoidal electrically conductive segment, a triangular electrically conductive segment and the like. In the present example, the length of the first arm segment 1001 is approximately twice that of the second arm segment 1002. In other examples, the length ratio between the first arm segment 1001 and the second arm segment 1002 can be flexibly selected. For example, the first arm segment 1001 may have a length equal to that of the second arm segment 1002, or even smaller than that of the second arm segment 1002, so far as the total length of the first arm segment and the second arm segment is ensured to meet requirements, for example, in the aspects of characteristics such as azimuth beam width, return loss and the like of the radiating elements.

Figure 5:
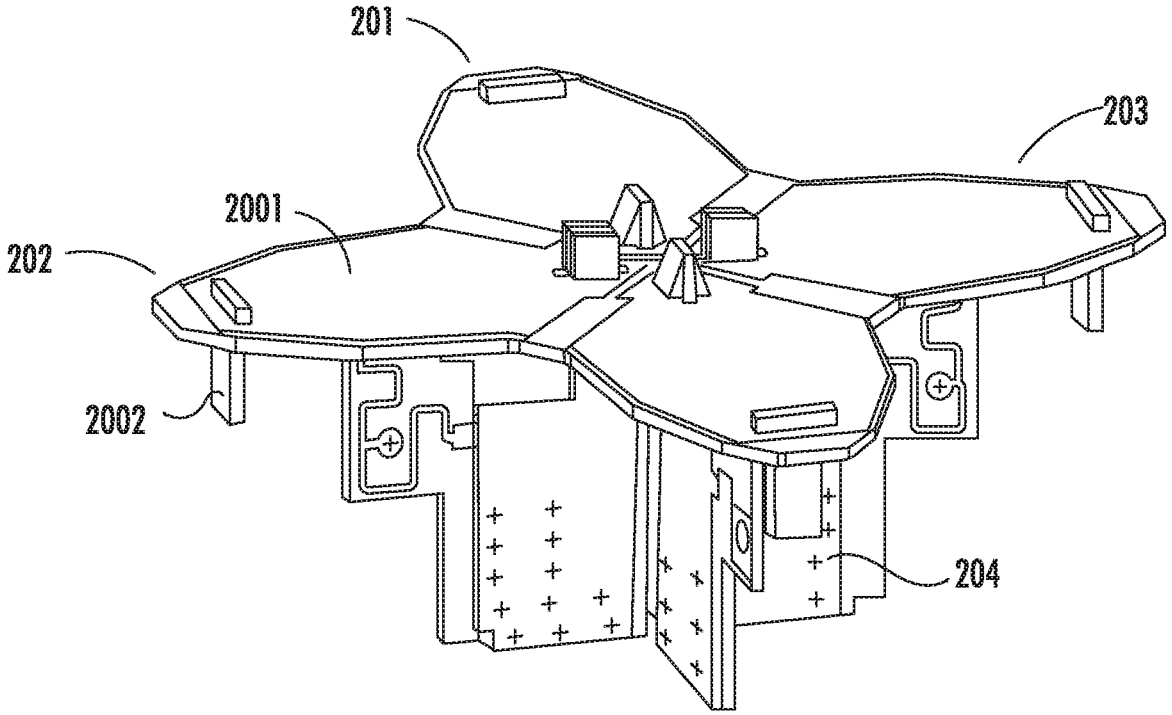
FIG. 5 is a perspective view of a radiating element in accordance with a second embodiment of the present invention.

Referring now to FIG. 5, a perspective view of a radiating element in accordance with a second embodiment of the present invention is shown. As shown in FIG. 5, each of the radiating arms 202, 203 of the radiating element 201 has a first arm segment 2001 and a second arm segment 2002 that extends perpendicular to the first arm segment 2001. The first arm segment 2001 is disposed on a PCB, while the second arm segment 2002 is no longer constructed on a feed stalk 204 but configured as a metal column (e.g., a copper metal column). In the present example, the metal column is a separate metal column and is spaced apart from the feed stalk 204.

Unlike the first embodiment of the present invention, as there is no need to construct an electrically conductive segment on the feed stalk 204 to serve as the second arm segment, the feed stalk 204 does not need to extend radially outwardly, and the radial dimension of the feed stalk 204 may be significantly shorter than that of the first arm segment 2001.

As can be seen from FIG. 5, the first arm segment 2001 is provided with a groove 209 at its end remote from a feed end. The second arm segment 2002 is inserted as a metal column into the groove 209 of the first arm segment 2001. Thus, the second arm segment 2002 can be mechanically connected to the first arm segment 2001 at a radially outer end (an end remote from the feed end) of the first arm segment 2001, thereby achieving electrical connection of the second arm segment 2002 with the first arm segment 2001. In order to further enhance this electrical connection, the first and second arm segments 2001, 2002 may be connected in one piece, for example, by means of soldering. Of course, the first arm segment 2001 and the second arm segment 2002 may also be electrically connected by means of a capacitive connection. The use of the capacitive connection can effectively reduce the passive intermodulation (PIM) of the antennas. In this way, the first arm segment 2001 and the second arm segment 2002 are formed as an integral radiating arm.

In other examples, the second arm segment may not be perpendicular to the first arm segment. For example, the second arm segment may be connected to the first arm segment at a certain angle of inclination (e.g. 10 degrees, 45 degrees, 75 degrees, etc.). It is also possible that the second arm segment is disposed above the first arm segment and connected to the first arm segment from top to bottom. Further, the second arm segment may also be of any other design. For example, the second arm segment may be a prismatic metal column, a cylindrical metal column, or the like. In the present example, the length of the first arm segment 2001 is approximately three times that of the second arm segment 2002. In other examples, the length ratio between the first arm segment 2001 and the second arm segment 2002 may be flexibly selected, so far as the total length of the first arm segment and the second arm segment is set to meet requirements, for example, in the aspects of characteristics such as azimuth beam width, return loss and the like of the radiating elements.

Figure 6A:
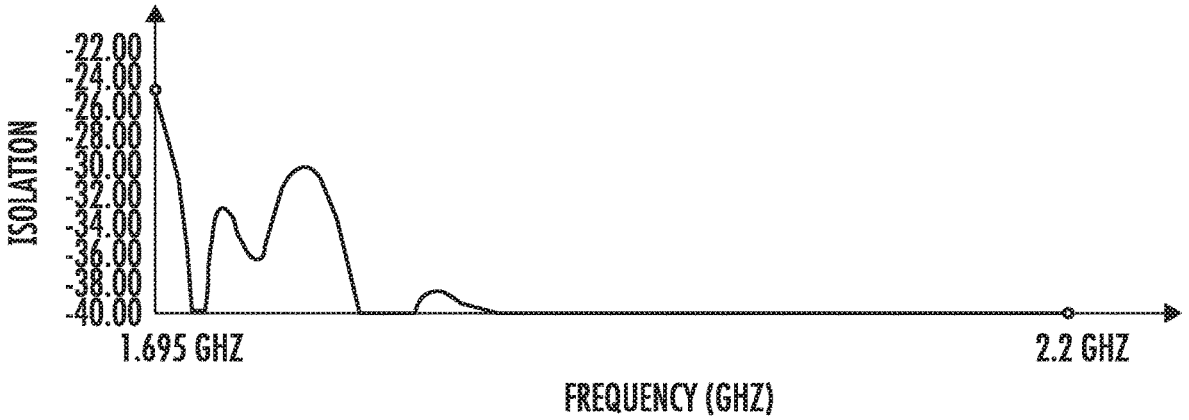
FIG. 6*a* is a characteristic curve diagram showing the isolation of the conventional radiating elements.
Figure 6B:
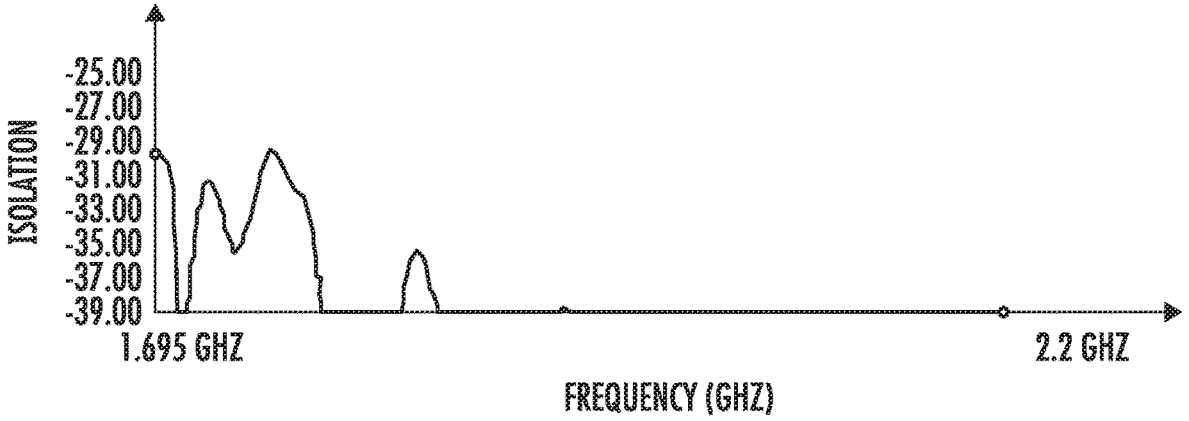
FIG. 6*b* is a characteristic curve diagram showing the isolation of the radiating elements according to embodiments of the present invention.
Figure 7A:
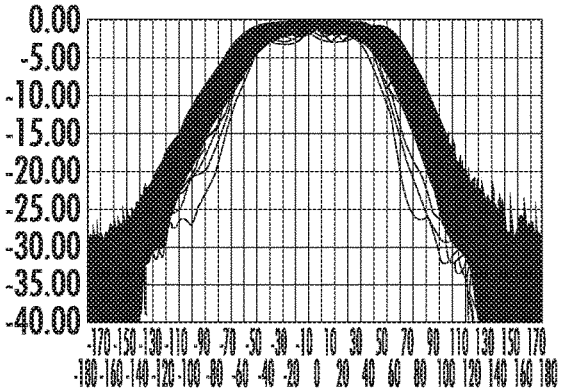
FIG. 7*a* is a horizontal pattern of an array of conventional radiating elements.
Figure 7C:
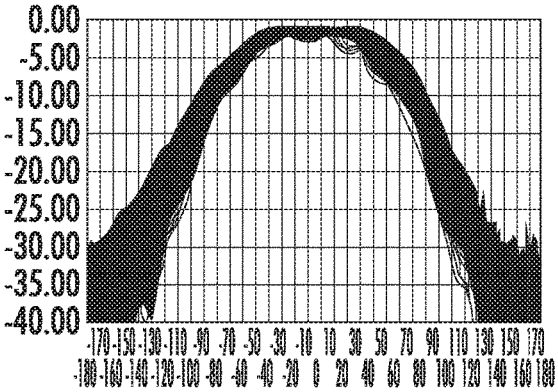
FIG. 7*c* is a horizontal pattern of an array of radiating elements according to embodiments of the present invention.
Figure 7B:
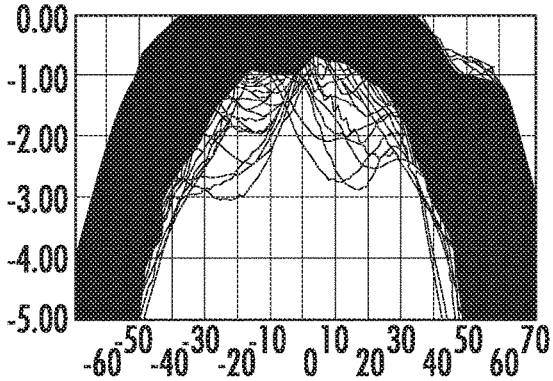
FIG. 7*b* is a partial enlarged view of the horizontal pattern of the array of conventional radiating elements.
Figure 7D:
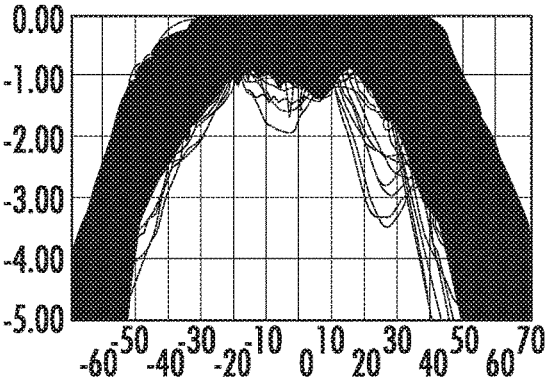
FIG. 7*d* is a partial enlarged view of the horizontal pattern of the array of radiating elements according to embodiments of the present invention.

Referring now to FIGS. 6*a* and 6*b*, FIG. 6*a* is a characteristic curve diagram showing the isolation of the conventional radiating elements and FIG. 6*b* is a characteristic curve diagram showing the isolation of the radiating elements according to embodiments of the present invention. Specifically, the abscissa shows the operating band of the radiating element (1695 MHz to 2200 MHz in this example), and the ordinate shows the isolation between the radiating elements (it is Co-pol isolation herein). The Co-pol isolation in the worst case, i.e. at a frequency of 1695 MHz, will be taken into account herein. As can be seen from the figures, at the frequency of 1695 MHz, the Co-pol isolation of the conventional radiating elements is about −25.1 dB, whereas the Co-pol isolation of radiating elements according to the present invention is about −29.1 dB. Thus, it can be seen that the isolation between the radiating elements can be effectively reduced by the embodiments according to the present invention.

Referring now to FIGS. 7*a* to 7*d*, horizontal (azimuth) patterns of an array of conventional radiating elements and that of an array of radiating elements in accordance with embodiments of the present invention under different operating frequencies are shown. As can be seen from the comparison between FIGS. 7*a* and 7*c*, in particular from the comparison between 7*b* and 7*d*, the beam forming performance of the array of radiating elements according to embodiments of the present invention is improved compared with the array of conventional radiating elements. Specifically, compared with the array of conventional radiating elements, the ripple waves in the horizontal pattern of the array of radiating elements according to embodiments of the present invention are significantly reduced and thereby is smoother.

Figure 8A:
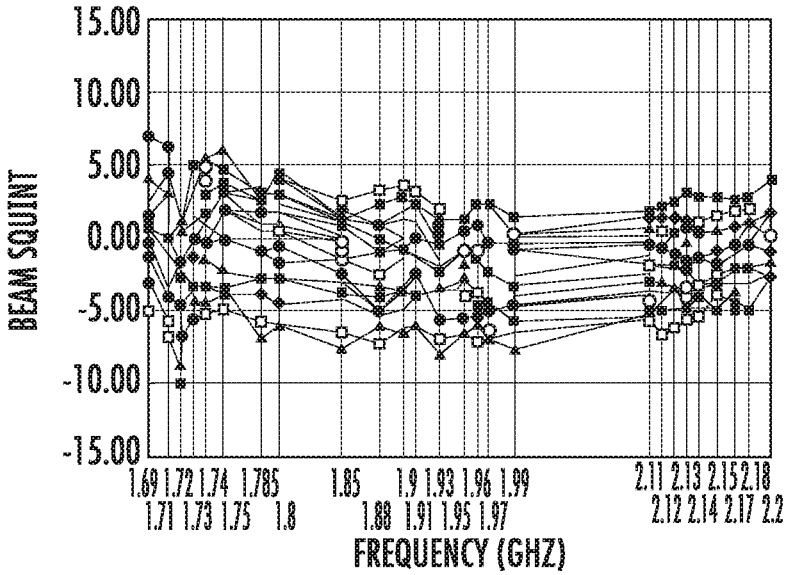
FIG. 8*a* is a view showing the beam squint of the conventional array of radiating elements.
Figure 8B:
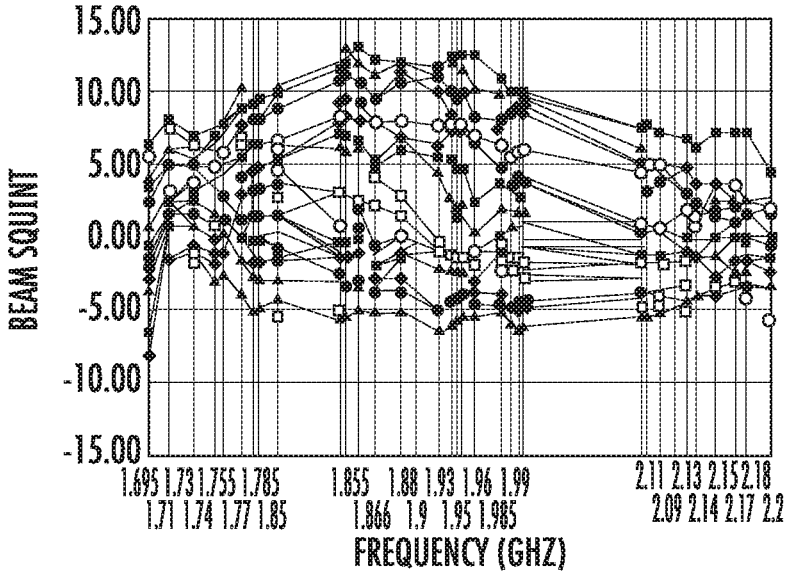
FIG. 8*b* is a view showing the beam squint of the array of radiating elements according to the present invention.

Referring now to FIGS. 8*a* and 8*b*, which show, respectively, beam squint of the array of conventional radiating elements and that of the array of radiating elements according to embodiments of the present invention. As can be seen from the comparison between FIGS. 8*a* and 8*b*, the beam squint of the array of radiating elements according to embodiments of the present invention is predominantly between +4 degrees and −5 degrees throughout the frequency bands. In contrast, the beam squint of the array of conventional radiating elements is approximately between +10 degrees and −5 degrees throughout the frequency bands. That is to say, the array of radiation elements according to embodiments of the present invention has a smaller beam squint. Thus, the array of radiating elements according to embodiments of the present invention can effectively improve the beam forming performance and the beam squint.

The present invention has been described above with reference to the accompanying drawings. The invention is not limited to the illustrated embodiments; rather, these embodiments are intended to fully and completely disclose the invention to those skilled in this art. It should also be understood that, the embodiments disclosed herein can be combined in various ways to provide many additional embodiments. In the drawings, like numbers refer to like elements throughout. In the drawings, for the sake of clarity, the sizes of certain features may be modified.

In the specification, words describing spatial relationships such as "up", "down", "left", "right", "forth", "back", "high", "low" and the like may describe a relation of one feature to another feature in the drawings. It should be understood that these terms also encompass different orientations of the apparatus in use or operation, in addition to encompassing the orientations shown in the drawings. For example, when the apparatus in the drawings is turned over, the features previously described as being "below" other features may be described to be "above" other features at this time. The apparatus may also be otherwise oriented (rotated 90 degrees or at other orientations) and the relative spatial relationships will be correspondingly altered.

The singular forms "a/an" and "the" as used in the specification, unless clearly indicated, all contain the plural forms. The words "comprising", "containing" and "including" used in the specification indicate the presence of the claimed features, but do not preclude the presence of one or more additional features. The wording "and/or" as used in the specification includes any and all combinations of one or more of the relevant items listed.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention.

Although the exemplary embodiments of the present invention have been described, a person skilled in the art should understand that, multiple changes and modifications may be made to the exemplary embodiments without substantively departing from the spirit and scope of the present invention. Accordingly, all the changes and modifications are encompassed within the protection scope of the present invention as defined by the claims. The present invention is defined by the appended claims, and the equivalents of these claims are also contained therein.

That which is claimed is:

1. A radiating element for an antenna, comprising:

a feed stalk; and at least one radiating arm, the radiating arm having a first electrically conductive arm segment that is supported on the feed stalk and extends in a first direction and a second electrically conductive arm segment extending in a second direction from a radially outer end region of the first electrically conductive arm segment, the second direction being different from the first direction, and the first arm segment and the second arm segment being separately constructed, wherein the second arm segment is electrically connected to the first arm segment, wherein the second arm segment is an electrically conductive segment of the feed stalk.

2. The radiating element according to claim 1, wherein the total length of the combination of the first arm segment and the second arm segment is equivalent to a radiating arm length of a half-wave radiating element.

3. The radiating element according to claim 2, wherein the radiating arm length of the half-wave radiating element is between 50% to 150% of a theoretical radiating arm length of the half-wave radiating element, wherein the theoretical radiating arm length of the half-wave radiating element equals one quarter of a wavelength corresponding to a center frequency of the operating frequency band of the half-wave radiating element.

4. The radiating element according to claim 1, wherein the first arm segment extends above and parallel to a reflector plate, and the second arm segment extends downwardly from the first arm segment toward the reflector plate.

5. The radiating element according to claim 1, wherein the second arm segment is soldered to the first arm segment.

6. The radiating element according to claim 1, wherein the second arm segment is electrically connected to the first arm segment by a capacitive connection.

7. The radiating element according to claim 1, wherein the second direction intersects the first direction.

8. The radiating element according to claim 7, wherein the second direction and the first direction form an angle between 80 degrees and 100 degrees.

9. The radiating element according to claim 1, wherein the first electrically conductive arm segment is on a first printed circuit board and the second electrically conductive arm segment is on a second printed circuit board that extends in a different plane than the first printed circuit board.

10. The radiating element according to claim 1, wherein the feed stalk is electrically coupled to both a base of the first electrically conductive segment and to a distal end of the first electrically conductive segment through respective first and second electrical connections.

11. A radiating element for an antenna, comprising:

at least one radiating arm, the radiating arm having a first electrically conductive arm segment extending in a first direction and a second electrically conductive arm segment extending in a second direction from a radially outer end region of the first electrically conductive arm segment, the second direction being different from the first direction, and the first arm segment and the second arm segment being separately constructed, wherein the second arm segment is electrically connected to the first arm segment, wherein the first arm segment is implemented in a first printed circuit board;

wherein the second arm segment is implemented in a second printed circuit board;

wherein the second printed circuit board is a feed stalk of the radiating element, and wherein the second arm segment is an electrically conductive segment on the feed stalk that is electrically separated from a feed circuit of the feed stalk.

12. The radiating element according to claim 11, wherein the electrically conductive segment comprises first and second electrically conductive segments formed on first and second surfaces of the feed stalk, and the electrically conductive segment further comprises at least one conductive element that extends through a dielectric substrate of the feed stalk to electrically connect the first and second electrically conductive segments.

13. A radiating element, comprising:

a feed stalk that includes a feed circuit;

a first center-fed radiating arm; and a second center-fed radiating arm, the first and second center-fed radiating arms forming a dipole, wherein the first radiating arm includes a first electrically conductive segment that is mounted on the feed stalk and a second electrically conductive segment that is implemented on the feed stalk and is electrically connected to the feed circuit through the first electrically conductive segment.

14. The radiating element according to claim 13, wherein the second electrically conductive segment is soldered to the first electrically conductive segment.

15. The radiating element according to claim 14, wherein the second electrically conductive segment is physically and electrically connected soldered adjacent a distal end of the first electrically conductive segment.

16. The radiating element according to claim 15, wherein the total length of the combination of the first electrically conductive segment and the second electrically conductive segment is equivalent to a radiating arm length of a half-wave radiating element.

17. The radiating element according to claim 13, wherein the first electrically conductive arm segment is on a first printed circuit board and the feed stalk comprises a second printed circuit board that extends in a different plane than the first printed circuit board.

18. The radiating element according to claim 13, wherein the feed stalk is electrically coupled to both a base of the first electrically conductive segment and to a distal end of the first electrically conductive segment through respective first and second electrical connections.

* * * * *